United States Patent [19]

Pitts et al.

[11] 4,023,948

[45] May 17, 1977

[54] SOLAR ENERGY REFRIGERATION AND AIR CONDITIONING SYSTEM

[76] Inventors: Clyde T. Pitts, 13608 Donward Court, Tampa, Fla. 33612; Herbert A. Ingley, 5009 NW. 34th Terrace, Gainesville, Fla. 32605; Erich A. Farber, 1218 NE. 5th St., Gainesville, Fla. 32601; Clayton A. Morrison, 2716 NW. 4th Ave., Gainesville, Fla. 32601

[22] Filed: May 27, 1975

[21] Appl. No.: 580,675

[52] U.S. Cl. ..... 62/191; 62/2; 62/500

[51] Int. Cl.[2] ..... F25B 1/06

[58] Field of Search ..... 62/500, 2, 191, 116; 236/17; 165/39; 417/1; 237/1 A

[56] References Cited

UNITED STATES PATENTS

| | | | |
|---|---|---|---|
| 1,978,382 | 10/1934 | Jones | 62/500 X |
| 2,200,138 | 5/1940 | Von Sauer | 62/500 X |
| 2,763,998 | 9/1956 | Tulleners | 62/500 |
| 3,242,679 | 3/1966 | Puckett et al. | 62/2 |
| 3,799,145 | 3/1974 | Butterfield | 237/1 A |

*Primary Examiner*—William E. Wayner
*Attorney, Agent, or Firm*—Arthur W. Fisher, III

[57] ABSTRACT

A solar energy refrigeration and air conditioning system for cooling an enclosed area comprising a low temperature vapor generator, condenser and evaporator specifically configured for use with a low boiling point refrigerant to use solar energy as a means of vapor generation. The low temperature vapor generator is coupled to an externally heated water source through a first fluid drive means. The low temperature vapor generator and evaporator feed refrigerant vapor to the condenser through means of an ejector while the liquid refrigerant is recirculated from the condenser to the low temperature vapor generator and evaporator by a second fluid drive means. Chilled fluid from the evaporator is circulated through a coil contained in an air handling system to cool the enclosed area. Of course, refrigerant could be evaporated in the evaporator by exposing evaporator heat exchange surfaces directly to the air in the duct thus cooling air directly.

8 Claims, 2 Drawing Figures

SOLAR ENERGY REFRIGERATION AND AIR CONDITIONING SYSTEM

BACKGROUND OF THE INVENTION

1. Field of the Invention

A solar energy refrigeration and air conditioning system for cooling an enclosed area comprising a low temperature vapor generator, condenser and evaporator specifically configured for use with a low boiling point refrigerant to use solar energy as a means of motive vapor generation.

2. Description of the Prior Art

Historically space conditioning devices have employed hydro-electric or hydrocarbon fuel as the energy source to power such devices. Generally, these devices or systems include compressors and electric motors which have relatively expensive initial costs, are noisy in operation and high in operating costs. Further, such components are subject to operational malfunctions requiring costly repair.

The additional shortcoming of the geographic limitations of hydro-electric power is obvious. Of course, the environmental factors associated with the hydrocarbon fuel systems are increasing the cost of operation. Moreover, these costs have recently been compounded with the limited supply of petroleum.

Thus, a real need for a clean, reliable, relatively inexpensive cooling system is apparent. The instant invention contemplates the use of solar energy to provide just a clean, inexpensive, highly reliable cooling system.

SUMMARY OF THE INVENTION

The present invention relates to a solar energy air conditioning system for cooling an enclosed area. More specifically, the solar energy air conditioning system comprises a low temperature vapor generator, condenser and evaporator configured to use solar energy as a means for vapor generation.

The low temperature vapor generator may comprise any suitable generator enclosure to maintain a refrigerant in heat exchange relation with heating surfaces of the generator. The generator heat exchanger surfaces are coupled to an external heated fluid source by means of generator inlet and outlet conduits to vaporize the refrigerant while within the generator. A first fluid drive means is operatively coupled between the generator enclosure and the heated fluid source by the generator inlet conduit. The first fluid drive means is also coupled to a pressure sensing means communicating with the interior of the generator enclosure to control the internal pressure thereof. As intended, the heated fluid source comprises a storage facility which is connected to a plurality of solar collectors. Of course, other suitable sources of heat energy may be substituted.

The condenser may similarily comprise a suitable condenser enclosure to maintain the refrigerant in a heat exchange relation with the condenser heat exchanger surfaces. The condenser heat exchange surfaces are coupled to a cooling fluid source through condenser inlet and outlet conduits or other devices arranged so as to cool and condense the refrigerant within the condenser heat exchange surfaces.

The evaporator may also comprise any suitable evaporator enclosure to maintain the refrigerant in heat exchange relation with the evaporator heat exchange surfaces. The evaporator heat exchange surfaces are coupled to an air conditioning unit through evaporator inlet and outlet conduits or other devices arranged so as to chill the fluid circulated through the evaporator heat exchange surfaces.

Vapor outlets of the low temperature vapor generator and evaporator are coupled to an ejector by a generator vapor supply conduit and an evaporator vapor supply conduit respectively. The ejector is, in turn, coupled to the condenser vapor inlet by a condenser vapor supply conduit.

A condenser liquid outlet is coupled to a generator liquid supply conduit and evaporator liquid supply conduit through a condenser liquid supply conduit. The generator liquid supply conduit and evaporator liquid supply conduit are, in turn, coupled to the low temperature vapor generator and high vacuum evaporator by a generator liquid inlet and evaporator liquid inlet respectively.

A second fluid drive means is coupled to the generator liquid supply conduit to force liquid through the generator liquid supply conduit to the generator. In addition, a liquid level sensor, coupled to the second fluid drive means, is disposed within the generator enclosure to automatically maintain a substantially constant liquid level therein.

In operation, the fluid heated by solar collectors and contained in storage is fed through the generator inlet conduit to the generator heat exchange surfaces by the first fluid drive means and recirculated to the solar collectors or storage through the generator outlet conduit. As the heated fluid passes through the generator heat exchange surfaces, the refrigerant within the generator enclosure is vaporized and passed from the vapor outlet through the generator vapor supply conduit to the ejector. The vapor passing through the ejector creates a suction through the evaporator vapor conduit supply. As a result; vapor is drawn from the evaporator through the vapor outlet thereof and evaporator vapor supply conduit to the ejector. There the vapor is combined and fed through the condenser vapor supply conduit and condenser vapor inlet into the condenser enclosure.

Once in the condenser enclosure, the vapor is condensed to liquid by the cooling effect of the condenser heat exchanger surfaces. The condenser heat exchanger surfaces are cooled by cooling fluid circulated through the condenser inlet and outlet conduits as previously described. The condensed refrigerant is fed from the condenser liquid outlet into the condenser liquid supply conduit. The liquid refrigerant is then fed through the evaporator and generator liquid supply conduits to the evaporator and generator enclosures respectively.

The liquid refrigerant, once in the evaporator enclosure, chills the fluid circulating through the evaporator heat exchanger surfaces as the liquid refrigerant is vaporized. The chilled fluid is then circulated through a heat exchanger and/or air handling facility to cool the enclosed area. At the same time, some of the liquid refrigerant is fed through the generator liquid supply conduit to the generator enclosure where the liquid refrigerant is vaporized by the generator heat exchanger surfaces as previously described.

In this manner, an efficient, reliable solar energy air conditioning system using a fluid as the heat exchanger medium is provided.

It is thus apparent that this combination of elements provides an effective and efficient solar energy air conditioning system.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and the objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
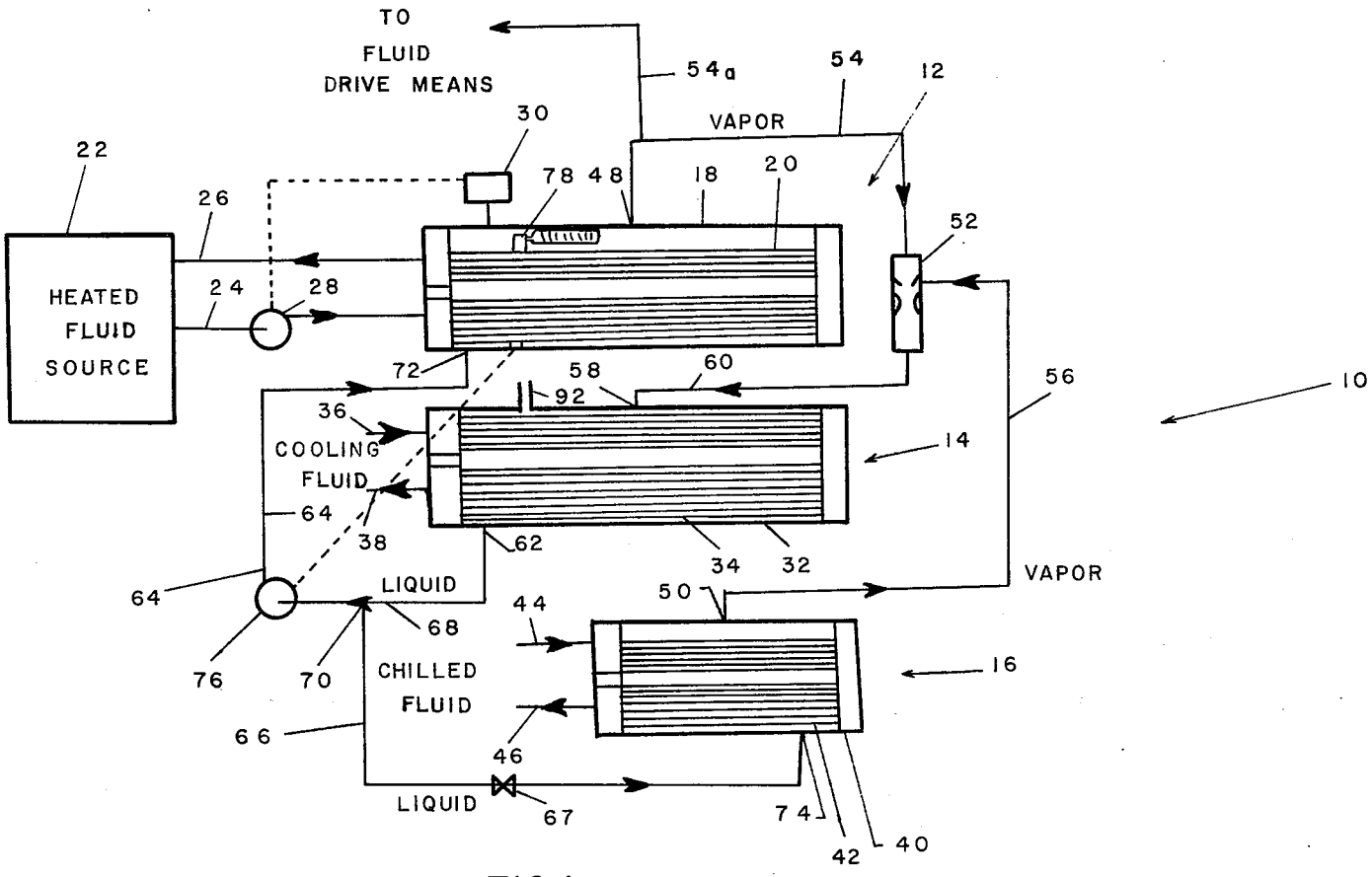
FIG. 1 is a block diagram of a solar energy air conditioning system.

As shown in FIG. 1, the present invention comprises a solar energy refrigeration and air conditioning system generally indicated as 10 specifically configured for use with solar energy as the means of vapor generation. The solar energy refrigerant and air conditioning system 10 includes a low temperature vapor generator 12, condenser 14 and evaporator 16 operatively interconnected as more fully described hereinafter to cool and enclosed area (not shown).

The low temperature vapor generator 12 may comprise any suitable construction including a generator enclosure 18 to maintain refrigerant in heat exchange relation with the generator heat exchanger surfaces 20. The generator heat exchanger surfaces 20 are coupled to a heated fluid source 22 through generator inlet and outlet conduits 24 and 26 respectively. A first fluid drive means 28 is coupled to the generator inlet conduit 24 to feed heated fluid from the heated fluid source 22 to the generator heat exchanger surfaces 20. A pressure sensing means 30 is operatively coupled between the first fluid drive means 28 and the generator enclosure 18 to control the operation of the fluid drive means 28 and maintain a substantially constant pressure within the generator enclosure 18. Although the system 10 is designed for use with solar collectors, other suitable sources of heat energy may be substituted for solar energy.

The condenser 14 may similarly comprise an suitable construction including a condenser enclosure 32 to maintain the refrigerant in heat exchange relation with the condenser heat exchanger surfaces 34. The condenser heat exchanger surfaces 34 are coupled to a cooled fluid souce (not shown) through condenser inlet and outlet conduits 36 and 38 respectively to cool and condense the refrigerant within the condenser enclosure 32.

The evaporator 16 may also comprise any suitable construction including an evaporator enclosure 40 to maintain the refrigerant in heat exchange relation with the evaporator heat exchanger surfaces 42. The evaporator heat exchanger surfaces 42 are coupled to a conditioning unit and/or conditioned space (not shown) through evaporator inlet and outlet conduits 44 and 46 respectively.

The vapor outlets of the low temperature vapor generator and evaporator 48 and 50 respectively are coupled to an ejector 52 by a generator vapor supply conduit 54 and an evaporator vapor supply conduit 56 respectively. The ejector 52 is, in turn, coupled to a condenser vapor inlet 58 by a condenser vapor supply conduit 60. A condenser liquid outlet 62 is coupled to a generator liquid supply conduit and an evaporator supply circuit 64 and 66 respectively by a condenser liquid supply conduit 68 through junction 70. The generator liquid supply conduit 64 and the evaporator liquid supply conduit 66 are, in turn, coupled to the low temperature vapor generator 12 and evaporator 16 by a generator liquid inlet 72 and an evaporator liquid inlet 74 respectively.

A second fluid drive means 76 is coupled to the generator liquid supply conduit 64 to feed liquid refrigerant from the condenser 14 to the generator 12. Liquid refrigerant is fed to the evaporator 16 by pressure differential in response to a pressure control valve 67. A liquid lever sensor 78, coupled to the second fluid drive means 76, is disposed within the generator enclosure 18 to control the operation thereof and maintain a substantially constant level therein.

Figure 2:
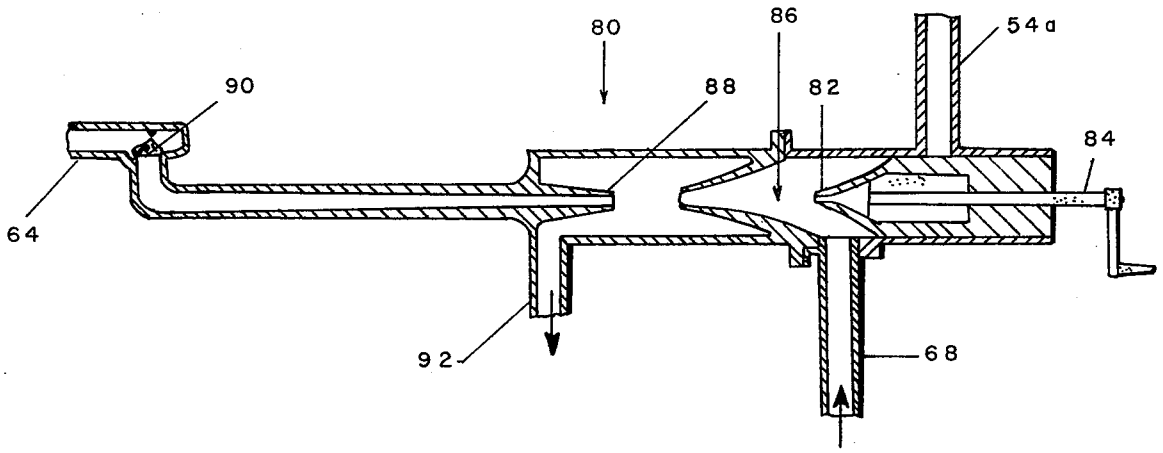
FIG. 2 is a detailed diagram of a fluid drive means.

FIG. 2 shows an alternate embodiment of the second fluid drive means 76. Specifically, the second fluid drive means 76 comprises housing 80, first nozzle 82 having adjustable needle valve 84 disposed therein, conical chamber 86, receiving cone 88 and check valve 90. In addition, an overflow circuit 92 is disposed beneath the control chamber.

In operation, heated fluid is fed through the generator inlet conduit 24 to the generator heat exchanger surfaces 20 by the first fluid drive means 28 and recirculated to the heated fluid source 22 through the generator outlet conduit 26. As the heated water passes through the generator heat exchanges surfaces 20, the refrigerant within the generator enclosure 18 is vaporized and passed from the vapor outlet 48 through the generator vapor supply conduit 54 to the ejector 52. The vapor passing through the ejector 52 creates a suction through the evaporator vapor supply conduit 56. As a result, vapor is drawn from the evaporator 16 through the evaporator vapor outlet 50 thereof and evaporator vapor supply conduit 56 to the ejector 52. There, the vapor from the generator 12 and the evaporator 16 is combined and fed through the condenser vapor supply conduit 60 and condenser vapor inlet 58 into the condenser enclosure 32.

Once in the condenser enclosure 32, the vapor is condensed to liquid by the cooling effect of the condenser heat exchanger surfaces 34. The condenser heat exchanger surfaces 34, as shown, are cooled by a cooling fluid circulated through the condenser inlet and outlet conduits 36 and 38 respectively as previously described. The condensed refrigerant is then drawn from the condenser liquid outlet 62 into the condenser supply conduit 68 by the second fluid drive means 76. Simultaneously, the liquid refrigerant is fed through the generator and evaporator liquid supply conduits 64 and 66 respectively to the generator and evaporator enclosures 18 and 40 respectively as previously described.

As previously described the alternate fluid drive means 76 of FIG. 2 comprises an injector as shown. In operation, vaporized refrigerant from the vapor generator 12 is fed through generator vapor supply conduit **54*a* to the injector housing 80 into the nozzle 82. The needle valve 84 may be adjusted longitudinal relative to the nozzle 82** to control the vapor jet of the refrigerant vapor. The vapor jet then enters the conical chamber 86 which communicates with the condenser 14 through condenser supply conduit 68. The vapor jet is forced through the conical chamber 86 producing a reduced pressure which draws liquid from the condenser 14 through conduit 68 and into the chamber 86. When this liquid reaches the vapor jet, it is driven out of the chamber 86 across the short open space into a slightly diverging tube or receiving cone 88 and through the check valve 90 into the vapor generator 12 through generator liquid supply conduit 64. Any overflow is returned to the condenser 14 through conduit 92. When the vapor and liquid flows into the nozzle 82 it gathers momentum and departs from the nozzle 82 in a high velocity jet. On striking the consenser liquid it imparts its momentum thereto so that the liquid is given more than enough momentum to be driven into vapor generator 14. A solenoid (not shown) may also be used in addition to the check valve 90 to control the flow into the condenser 14.

In this manner, an efficient, reliable solar energy air conditioning system using a fluid as the heat exchange medium is provided.

It is thus apparent that this combination of elements provides an effective and efficient solar energy air conditioning system.

It will thus be seen that the objects set forth above, among those made apparent from the proceding description, are efficiently attained, and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described.

What is claimed is:

1. An air conditioning system for cooling an enclosed area comprising a vapor generator operatively coupled to an externally disposed heated fluid source, said heated fluid source being coupled to said vapor generator through a first fluid drive means to supply heated fluid to said vapor generator, a condenser operatively coupled to the output of said vapor generator through an ejector means, said condenser coupled to the input of said vapor generator by a second fluid drive means to return condensed refrigerant from said condenser to said vapor generator, and an evaporator for chilling fluid for air conditioning the enclosed area, the output of said evaporator coupled to said condenser through said ejector means to return vaporized refrigerant from said evaporator to said condenser and the output of said condenser being coupled to the input of said evaporator to feed condensed refrigerant from said condenser to said evaporator, said system further including a pressure sensing means coupled between said vapor generator and said first fluid drive means to maintain a substantially constant pressure in said vapor generator.

2. The solar energy air conditioning system of claim 1 wherein said vapor generator comprises a low temperature vapor generator including a generator enclosure having generator heat exchanger surfaces disposed therein; said generator heat exchanger surfaces being coupled to the externally disposed heated fluid source by generator inlet and outlet conduits to circulate the heated fluid through said generator heat exchanger surfaces to maintain refrigerant within said generator enclosure in heat exchange relation with the said generator exchanger surfaces.

3. The solar energy air conditioning system of claim 2 wherein said first fluid drive means comprises a pumping means operatively coupled to said generator inlet conduit.

4. The solar energy air conditioning system of claim 1 wherein said condenser comprises a condenser enclosure having condenser heat exchanger surfaces disposed therein, said condenser heat exchanger surfaces being coupled to an externally disposed cooling fluid source by condenser inlet and outlet conduits to circulate cooled fluid through said condenser heat exchanger surfaces to maintain refrigerant within said condenser enclosure in heat exchange relation with said condenser heat exchanger surfaces.

5. The solar energy air conditioning system of claim 1 wherein said evaporator comprises an evaporator including an evaporator enclosure having evaporator heat exchanger surfaces disposed therein; said evaporator heat exchanger surfaces being coupled to an externally disposed air handler unit by evaporator inlet and outlet conduits to circulate the chilled fluid through said evaporator enclosure in heat exchange relation with said evaporator heat exchanger surfaces.

6. The solar energy air conditioning system of claim 1 wherein said vapor generator further includes a liquid level sensing means, said liquid level sensing means being operatively coupled to the said second fluid drive means to maintain a predetermined liquid level within said vapor generator.

7. The solar energy air conditioning system of claim 1 wherein said second fluid drive means includes a check valve disposed between the output of said condenser and the input of said vapor generator.

8. The solar energy air conditioning system of claim 1 wherein said second fluid drive means comprises an injector, said injector including an injector housing operatively coupled between said condenser and said vapor generator, said injector housing having a nozzle formed on the input thereof to receive vapor from said vapor generator and generate a vapor jet, a substantially conically shaped chamber to impart a momentum to said liquid from said condenser to drive the liquid into said vapor generator.

* * * * *